US005400471A

United States Patent [19]

Lichfield et al.

[11] Patent Number: 5,400,471

[45] Date of Patent: Mar. 28, 1995

[54] AUXILIARY HANDLE

[75] Inventors: William H. Lichfield, Corinne; Dale W. Lichfield, Brigham City, both of Utah

[73] Assignee: Rad-Cam, Inc., Brigham City, Utah

[21] Appl. No.: 62,809

[22] Filed: May 11, 1993

[51] Int. Cl.[6] ..... B25G 3/00; E05B 7/00

[52] U.S. Cl. ..... 16/114 R; 16/115

[58] Field of Search ..... 16/114 R, 225, 115; 294/58

[56] References Cited

U.S. PATENT DOCUMENTS

| | | | |
|---|---|---|---|
| 875,504 | 12/1907 | Clark . | |
| 1,194,197 | 8/1916 | Jones . | |
| 2,337,643 | 12/1943 | Buser . | |
| 3,751,094 | 8/1973 | Bohler . | |
| 3,912,140 | 10/1975 | Frahges | 16/114 R |
| 4,103,954 | 8/1978 | Vaslas . | |
| 4,128,266 | 12/1978 | Vaslas . | |
| 4,701,142 | 10/1987 | Merritt | 16/114 R |
| 4,787,661 | 11/1988 | Rutledge . | |
| 4,944,541 | 7/1990 | Waldschmidt . | |

FOREIGN PATENT DOCUMENTS

| | | | |
|---|---|---|---|
| 584189 | 1/1947 | United Kingdom | 294/58 |

*Primary Examiner*—P. Austin Bradley
*Assistant Examiner*—Chuck Y. Mah
*Attorney, Agent, or Firm*—Thorpe, North & Western

[57] ABSTRACT

An auxiliary handle for use on a hand held implement such as a shovel advantageously provides a molded, unitary frame having hinges molded therein. The auxiliary handle can be precisely positioned for a particular user/implement combination. The frame provides a location where the user grasps the apparatus. The frame is a unitary piece of material which is free from any fasteners, such as nuts and bolts, and which is preferably injection molded from a polypropylene material. The frame includes a middle hinge at substantially at its midpoint so that the frame can assume a any angular orientation between a fully extended linear orientation or can be folded upon itself for shipping and storage. Also provided are end hinges at each end of the frame. Attached to the end hinges, and preferably partially molded therein, are metallic circular clamps which grip the original handle of the implement. The hinges used in the apparatus are molded from a polypropylene material and are of the type known as "living hinges." The use of such hinges allows nearly the entire apparatus to be fabricated in one molding step and avoids the difficulties inherent in the use of other types of hinges.

19 Claims, 4 Drawing Sheets

AUXILIARY HANDLE

BACKGROUND

1. The Field of the Invention

This invention relates to hand tools and hand held implements, such as shovels, and particularly to handles for use with such implements.

2. The Background Art

Hand held implements, such as shovels, are among the simplest of tools and find widespread use throughout the world. It is widely recognized that the commonly used shovel having a shaft-like handle provides poor mechanical advantage for the user. A user wielding a straight handle shovel can experience injury, for example lower back injury, especially when moving heavy loads.

In an effort to improve the working of such shovels, there have been previous attempts to provide an auxiliary handle for shovels and other hand held implements. Unfortunately, such auxiliary handles have exhibited one or more significant drawbacks and disadvantages.

For example, many previously available devices required that the original handle of the implement be substantially modified before the auxiliary handle could be attached. Also, some previously available devices can only be used with original handles which are specifically designed for such purposes. For example, some prior auxiliary handle devices require a metallic handle through which holes or grooves are formed. In either case, the end user is generally required to buy a new implement in addition to already owned similar implements or severely modify his old implements for use with the new auxiliary handle.

Moreover, previously available devices often require fasteners for assembly. Disadvantageously, fasteners such as bolts and nuts can be misplaced, can come loose and fall out, and can be inconvenient to install. Furthermore, the previously available devices are fabricated out of metal components which, due to the environment in which many hand held implements are used, are subject to corrosion. Corrosion of metal parts results in weakening of the device and hindering or even arresting of the movement of articulating parts.

In view of these drawbacks and disadvantages, it would be an advance in the art to provide an improved auxiliary handle for use with a variety of hand held implements.

BRIEF SUMMARY AND OBJECTS OF THE INVENTION

In view of the above described state of the art, the present invention seeks to realize the following objects and advantages.

It is a primary object of the present invention to provide an improved auxiliary handle for use on a variety of hand held implements.

It is also an object of the present invention to provide an auxiliary handle which can be fitted onto a variety of different implement handles without requiring modification of the original handle.

It is another object of the present invention to provide an auxiliary handle which can be used with a variety of different implements and with different original handles.

It is a further object of the present invention to provide an auxiliary handle apparatus which is strong and lightweight.

It is a still further object of the present invention to provide an auxiliary handle apparatus which resists corrosion, does not require any misplaceable fasteners, and which is convenient to install and remove.

These and other objects and advantages of the invention will become more fully apparent from the description and claims which follow, or may be learned by the practice of the invention.

The present invention provides an auxiliary handle for use on a hand held implement such as a shovel. The auxiliary handle makes the implement easier for the user to manage and manipulate. The apparatus of the present invention can be used on many different implements and is particularly adapted for use on implements having an elongated shaft as an original handle.

The present invention includes a frame, or frame means, for providing a grasping location where the user grasps the apparatus. The frame means comprises a unitary piece of material free from any fasteners, such as nuts and bolts, and which is preferably molded from a polypropylene material. A middle hinge, or hinge means, is molded into the frame substantially at its midpoint so that the frame can assume any angular orientation between a fully extended linear orientation and a folded upon itself orientation which is used for shipping and storage.

The hinges used in the apparatus of the present invention are preferably molded from a polypropylene material and are referred to in the industry as "living hinges." The use of such hinges allows nearly the entire apparatus to be fabricated in one molding step and avoids the difficulties inherent in the use of other types of hinges.

Positioned at each of the two ends of the frame means are end hinges, or hinge means, integrally molded from the same polypropylene material as the frame. Attached to the end hinges, and preferably partially molded therein, are clamps which perform the function of means for gripping the original handle of the implement. The clamps are preferably metallic circular clamps which encircle the original handle and, when tightened, securely hold the original handle.

A grip means for receiving the grasp of a user, for example a cylindrical grip mounted on the frame, can be positioned at the optimum location for the user/implement combination. The apparatus can be removably attached to the original handle such that (1) the distance between the grip and the original handle can be adjusted, (2) the angular orientation of the grip in relation to the original handle can be adjusted, (3) the distance between the first and second clamps can be adjusted, and (4) the entire apparatus can be moved to another location on the original handle while retaining the distance between the grip and the original handle. The adjustments provided by the apparatus allow a user to precisely position the auxiliary handle in the desired position.

BRIEF DESCRIPTION OF THE DRAWINGS

In order to better appreciate how the above-recited and other advantages and objects of the invention are obtained, a more particular description of the invention briefly described above will be rendered by reference to a specific embodiment thereof which is illustrated in the appended drawings. Understanding that these drawings depict only a typical embodiment of the invention and are not therefore to be considered limiting of its scope, the invention will be described and explained with additional specificity and detail through the use of the accompanying drawings in which.

DETAILED DESCRIPTION OF THE PREFERRED EMBODIMENT

Reference will now be made to the drawings wherein like structures will be provided with like reference designations.

Figure 1:
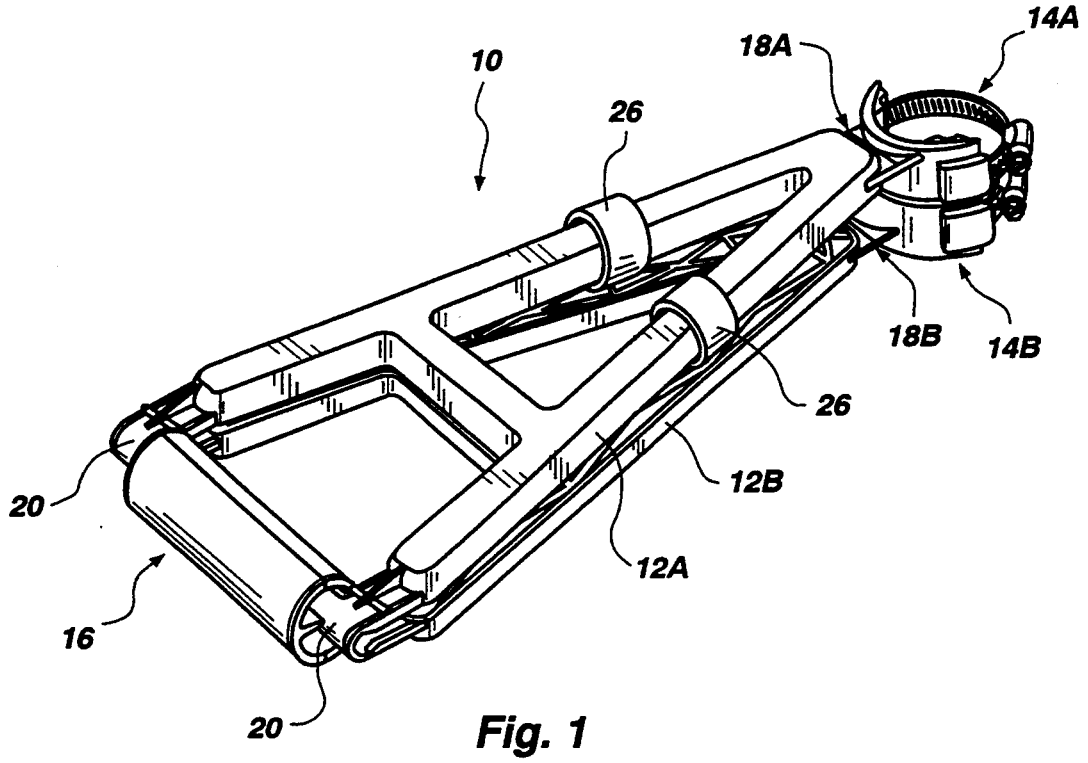
FIG. 1 is a perspective view of the presently preferred embodiment of the present invention.
Figure 3:
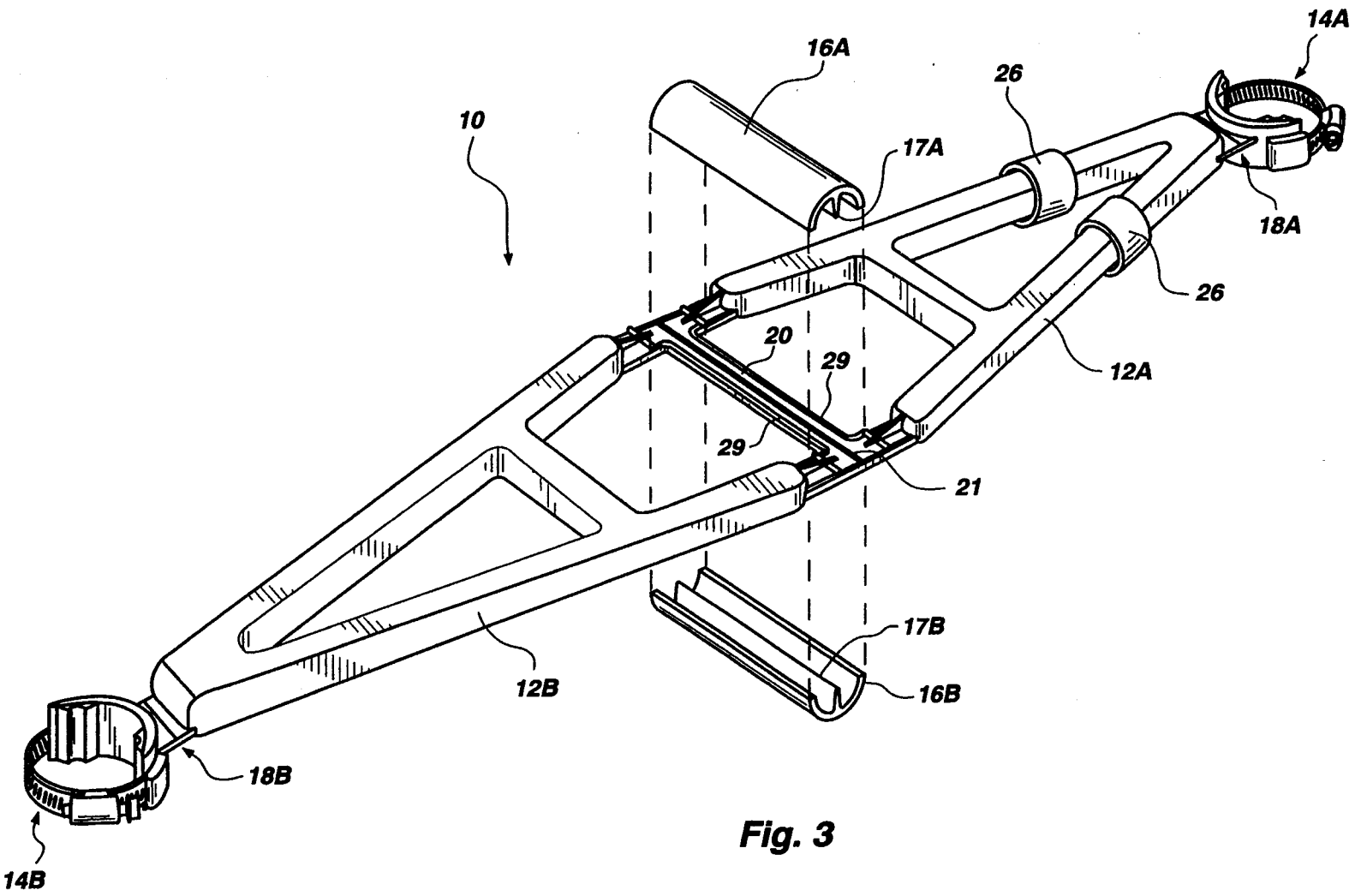
FIG. 3 is a partially exploded perspective view of the apparatus illustrated in FIG. 1.

FIG. 1 is a perspective view of the presently preferred embodiment of the present invention generally designated 10. The largest component of the apparatus 10 is a frame which comprises arms 12A and 12B. The apparatus 10 is shown in its folded configuration. The folded configuration illustrated in FIG. 1 allows the apparatus 10 to be shipped, stacked, and stored more economically than if the frame were in its fully extended configuration as illustrated in FIG. 3.

Still referring to FIG. 1, hinges 20, 18A and 18B are provided at the middle of the frame of the apparatus 10 and at each end thereof, respectively. The end hinges 18A and 18B each join a gripper 14A and 14B, respectively, to the frame of the apparatus 10. The grippers 14A and 14B are configured to each grip on original handle of an implement, such as a shovel. A pair of bushings 26 are provided to allow the grippers 14A and 14B to securely grip original handles of implements which are less than a minimum diameter. The pair of bushings 26 are conveniently clipped to one of the arms 12A or 12B when not in use as shown in FIG. 1.

The illustrated structure is the presently preferred arrangement for a frame means of the present invention. It will be appreciated, however, that many other structures can perform equivalent functions and can also be used.

A grip, generally designated at 16, is located at the middle hinge 20. As will be described shortly, the grip 16 is configured to cooperate with the middle hinge 20. The grip 16 provides a user a comfortable and convenient location to grasp while manipulating the implement.

Importantly, the arms 12A and 12B, middle hinge 20, and end hinges 18A and 18B are integral with each other being molded as a single piece. Those skilled in the art will appreciate the advantages and techniques needed to form the hinge structures from a plastic material, for example, polypropylene. The hinges used in the apparatus of the present invention are preferably molded from a polypropylene material and are referred to in the industry as "living hinges." The illustrated arm 12A and 12B structures are preferred. Those skilled in the art will be able to arrive at different configurations for the arms 12A and 12B which provide the strength and rigidity which will provide an apparatus which is suitable for a particular application.

Fabricating the entire frame of the apparatus 10 at the same time as the hinges 20, 18A, and 18B, and from the same material, provides advantages of economy and ease of fabrication not heretofore available in the art. It is preferred that the illustrated structures be formed using materials and injection molding techniques which can be arrived at by those skilled in the art using the information contained herein.

The illustrated structure provides the advantages of high strength, light weight, corrosion resistance, and does not require any fasteners such as nut and bolts. The illustrated apparatus 10 also avoids the durability and strength problems inherent when conventional hinges are attached to discrete frame components. The preferred hinges 20, 18A and 18B are durable, will not corrode, and are expected to flex as necessary over the useful life of the implement to which the apparatus 10 is attached.

It is also preferred that the grippers 14A and 14B be molded onto the distal portions of end hinges 18A and 18B at the same time as the arms 12A and 12B are formed. When grippers 14A and 14B are molded onto the hinges 18A and 18B nearly the whole apparatus 10 is formed in a single molding step. Thus, the apparatus of the present invention can be manufactured very economically. As represented in the figures, the grippers 14A and 14B preferably comprise circular clamp structures which will encircle and grip the original handle of an implement when tightened.

Figure 2:
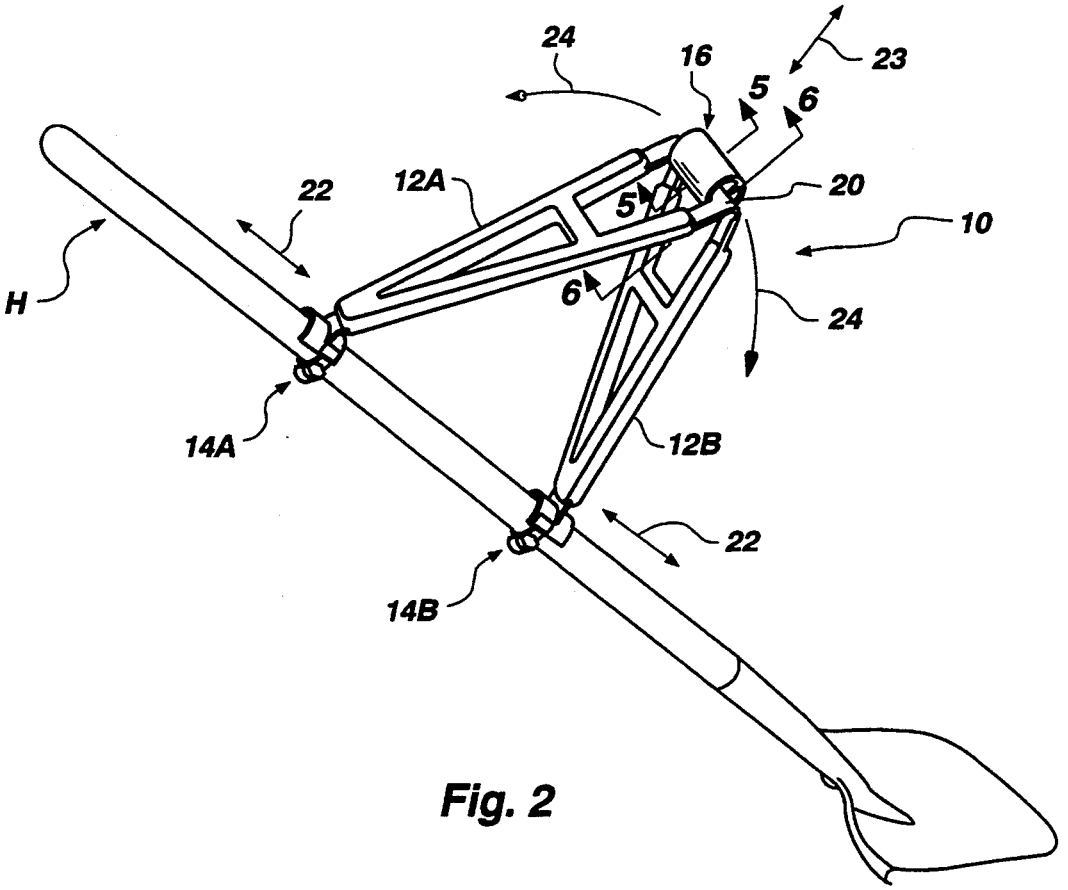
FIG. 2 is a perspective view of the apparatus illustrated in FIG. 1 installed on an original handle of an implement.

FIG. 2 illustrates a preferred application of the apparatus 10 providing an auxiliary handle on a shovel. The shovel is provided with a shaft-like original handle H as is known in the art. In use, the grippers 14A and 14B are placed on the handle H and tightened to hold the apparatus 10 in place. The apparatus 10 can be readily adjusted in several directions. The adjustments which can be carried out by the apparatus 10 allow it to be adapted to many different implements, users, and tasks. The same adjustments also allow the position of the grip 16 to be infinitely varied in relation to the original handle H. While the apparatus 10 is illustrated as being installed on a shovel, it will be appreciated that the apparatus can also be installed on a variety of other implements.

Still referring to FIG. 2, as represented by arrows 22, the location of either of the grippers 14A and 14B on the original handle H can be adjusted. If the location of one gripper, for example gripper 14A, is adjusted while the location of the other gripper 14B is not adjusted, the distance between the grip 16 and the original handle H is adjusted as represented by arrow 23. Conversely, if the locations of both grippers 14A and 14B are adjusted the same amount, the distance between the grip 16 and the original handle H remains the same. Moreover, the angular orientation of the grip 16 in relation to the handle H, as represented by arrows 24, can also be adjusted. Providing the apparatus 10 with the ability to adjust the location of the grip 16 in the three direction represented by arrows 22, 23, and 24 is a great advantage to the users of the apparatus 10. The described adjustments allow the apparatus 10 to be optimally oriented for a particular combination of user and implement as well as adjusting the apparatus 10 for the particular task to be performed.

Figure 4:
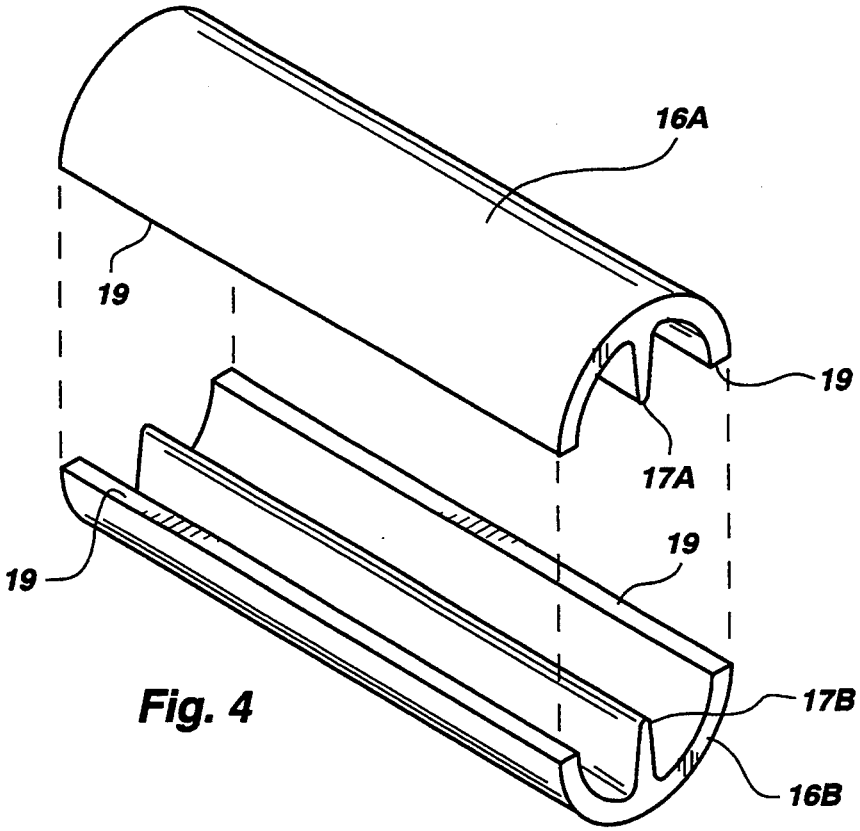
FIG. 4 is a perspective view of the components forming the grip of the apparatus illustrated in FIG. 1.

FIGS. 3–6 will be used to further explain the structure of the middle hinge 20 and the grip 16. FIG. 3 shows the frame fully extended. As shown in FIGS. 3 and 4, the grip is comprised of an upper grip segment 16A and a lower grip segment 16B. Each grip segment is provided with a central rib 17A and 17B, respectively.

Figure 5:
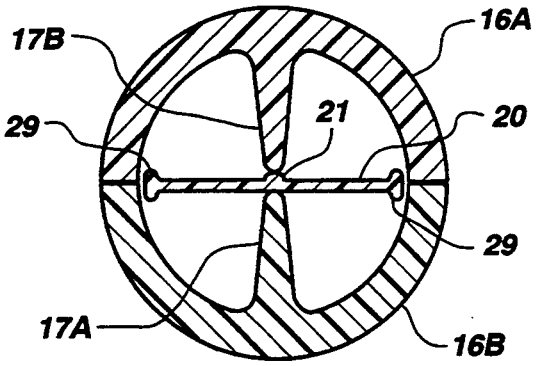
FIG. 5 is a cross sectional view taken along line 5—5 of FIG. 2.

The grip segments 16A and 16B are bonded together, when in position, along their edges 19 using one of the materials and techniques known in the art. When the grip segments 16A and 16B are bonded together in place about the middle hinge 20 (as illustrated in FIG. 3), the central ribs 17A and 17B contact the middle hinge 20 as shown best in the cross sectional view of FIG. 5. A bulge 21 is provided on the upper surface of the middle hinge 20 which contacts the central rib 17A as shown in FIG. 5. A perimeter ridge 29 is also preferably provided on the middle hinge 20.

The structure of the middle hinge 20 as illustrated in FIG. 3 is the preferred arrangement but other structures can be used within the scope of the present invention. The dimensions of the middle hinge 20 and the upper and lower grip segments 16A and 16B are such that the middle hinge 20 flexes properly. The cross sectional view of FIG. 5 illustrates the orientation of the portion of the middle hinge 20 which is enclosed within the grip 16. It can be seen in FIG. 5 that the central portion of the middle hinge 20 is kept from substantially flexing. Also, the contact between the grip 16 and the middle hinge 20 stably holds the grip 16 in position for the user as the user applies force to the grip 16.

Figure 6:
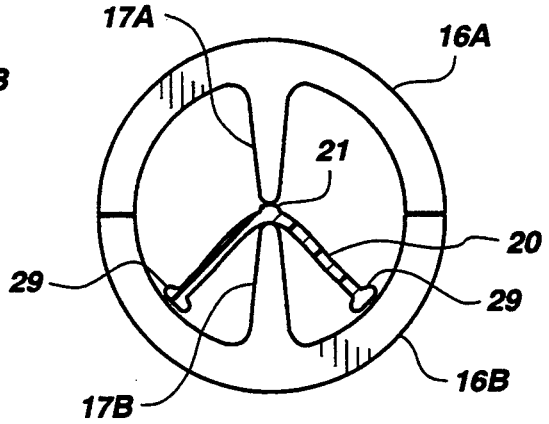
FIG. 6 is a partial cross sectional view taken along line 6—6 of FIG. 2.

FIG. 6 shows the flexing of the middle hinge 20 adjacent to the ends of the grip 16. It will be appreciated that the middle hinge 20 and the structures associated therewith must provide appropriate stiffness and strength while remaining flexible in the proper direction. The illustrated hinge fabricated from polypropylene provides the desired characteristics. Other materials, however, can also be used within the scope of the present invention.

Figure 8:
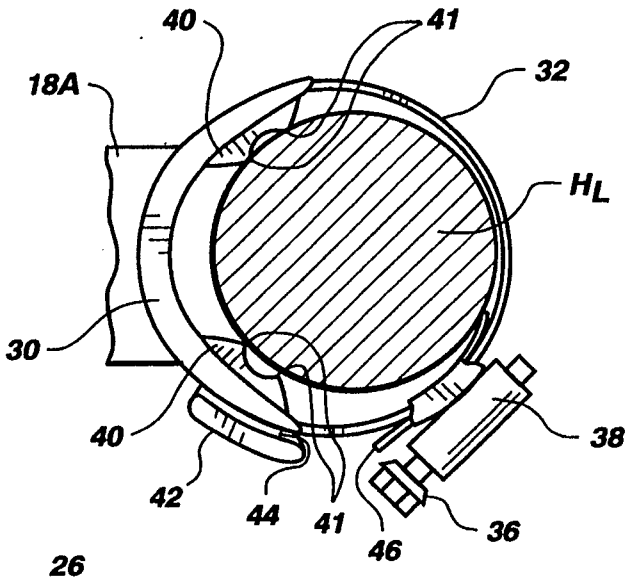
FIG. 8 is a cross sectional view of the structure illustrated in FIG. 7 gripping a larger original handle.
Figure 9:
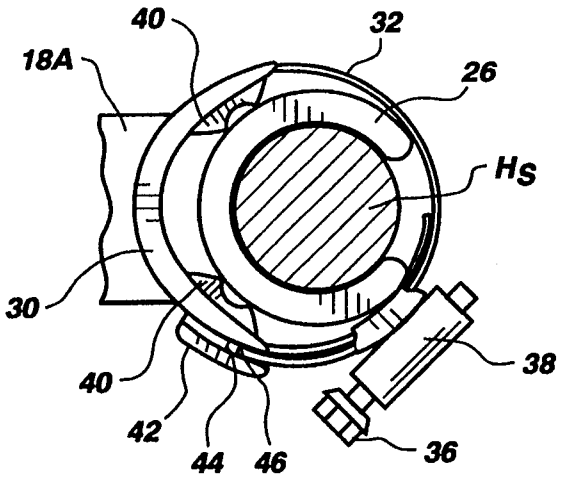
FIG. 9 is a cross sectional view of the structure illustrated in FIG. 7 gripping a smaller original handle.
Figure 7:
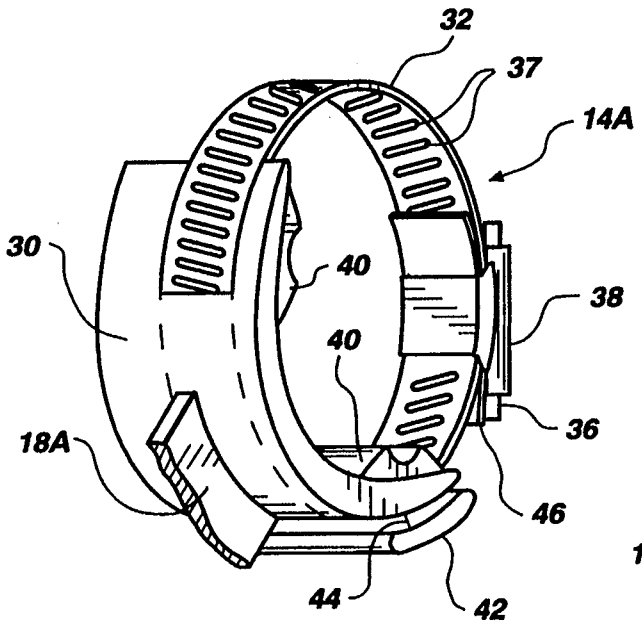
FIG. 7 is a perspective view of the structures illustrated in FIG. 1 which grip the original handle.

FIGS. 7–9 illustrate the functioning of the gripper 14A with two different sizes of original handles, a larger handle $H_L$ and a smaller handle $H_S$. FIG. 7 also illustrates how a circular clamp 32 is molded into a gripper body 30. The circular clamp 32 is preferably of a type commonly referred to as a hose clamp but other structures can also be used to secure the gripper 14A to the original handle. It will be appreciated that the preferred structures will securely grip whatever size or type of original handle is being used.

The structures of the gripper 14A should also allow easy adjustment and removal of the apparatus 10. Moreover, the illustrated arrangement grips the original handle without requiring the use of loose fasteners such as bolts and nuts which can easily be misplaced. The illustrated circular clamp 32 is preferred for use with wooden original handles but can be used with other original handles.

It will be understood that molding the circular clamp 32 into place at the same time as the frame structures are molded allows the apparatus to be economically fabricated. By molding the circular clamp 32 into the gripper body 30, the circular clamp 30 are held in place as the apparatus is positioned on the original handle. The circular clamp 32 should be positioned so that a mass of the gripper body 30 is held between the original handle $H_L$ or $H_S$ as shown in FIGS. 8 and 9.

Each of the grippers 14A and 14B are provided with knolls 40 upon which ridges 41 are formed. The knolls 40 and ridges 41 provided on the inside surface of the grippers 14A and 14B ensure that the original handle $H_L$ or $H_S$ is securely gripped. In the case of the smaller original handle $H_S$ (FIG. 9), a bushing 26 (also illustrated in FIG. 1) is fitted onto the original handle $H_S$ so that the circular clamp 32 can tightly hold the original handle $H_S$. The bushings 26 can be formed by molding at the same time as the frame of the apparatus 10 is formed and manually placed onto the frame as represented in FIG. 1.

Still referring to FIG. 9, as is known in the art, the circular clamp 32 is tightened and loosened by rotating a screw 36 which is held captive in a housing 38. As the screw 36 is rotated within the housing 38, the threads (not illustrated) of the screw engage the diagonal slots 37 and the perimeter of the circular clamp 32 is selectively lengthened or shortened.

It will be appreciated that when some handles are accommodated, the end 46 of the circular clamp 32 will protrude a significant distance from the housing 38. In such cases, the end 46 of the circular clamp 46 is directed into a gap 44 provided in a keeper 44 as shown in FIG. 9 so that the end 46 of the circular clamp will remain unobtrusive.

In the case of the larger handle $H_L$ represented in FIG. 8, the knolls 40 and ridges 41 provided on the inside surface of the gripper 14A securely hold the larger handle $H_L$ in place. When desired, the original handle can be removed, or the location of the grippers on the original handle adjusted, without any difficulty on the part of the user.

In view of the foregoing, it will be appreciated that the present invention provides an improved auxiliary handle for use on a variety of hand held implements without requiring modification of the original handle. The present invention also provides an auxiliary handle which can be used with a variety of different implements and with different original handles and which is strong and lightweight. The apparatus of the present invention also has the advantages of resisting corrosion, not requiring any misplaceable fasteners, and being convenient to install, adjust, and remove. Moreover, the apparatus of the present invention can be dedicated to a particular implement or can preferably retrofit a variety of different implements and readily be moved from one implement to another.

The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An auxiliary handle for use on a hand held implement having a rigid shaft used as an original handle, the auxiliary handle comprising:

frame means for providing a grasping location, the frame means having a first end and a second end and comprising a unitary piece of material free from any fasteners and further comprising:

first hinge means, positioned at the first end of the frame means and being integral with the rest of the frame means, for pivoting in a plane;

second hinge means, positioned at the second end of the frame means and being integral with the rest of the frame means, for pivoting in a plane;

third hinge means, positioned at the grasping location and being integral with the rest of the frame means, and for allowing the frame means to fold at a point intermediate of the first and second hinge means;

first means for gripping the shaft of the implement such that the shaft of the implement is tightly held by the first means for gripping and such that shaft cannot substantially slide in relation thereto, the first means for gripping connected to the first hinge means;

second means for gripping the shaft of the implement such that the shaft of the implement is tightly held by the second means for gripping and such that shaft cannot substantially slide in relation thereto, the second means for gripping connected to the second hinge means; and grip means for receiving the grasp of a user, the grip means positioned at the grasping location, such that the first and second means for gripping can be removably attached to the shaft such that a first distance between the grip means and the shaft can be adjusted, an angular orientation of the grip means in relation to the shaft can be adjusted, and a second distance between the first and second means for gripping can be adjusted thus providing an adjustable auxiliary handle for the user.

2. An auxiliary handle for use on a hand held implement as defined in claim 1 wherein the frame means comprises a polypropylene material.

3. An auxiliary handle for use on a hand held implement as defined in claim 1 wherein the frame means comprises an injection molded polypropylene frame.

4. An auxiliary handle for use on a hand held implement as defined in claim 1 wherein the frame means comprises a polypropylene material and the first hinge means comprises a polypropylene hinge.

5. An auxiliary handle for use on a hand held implement as defined in claim 1 wherein the frame means comprises a polypropylene frame and the first, second, and third hinge means comprise polypropylene hinges.

6. An auxiliary handle for use on a hand held implement as defined in claim 1 wherein the first and the second means for gripping both comprise a circular clamp.

7. An auxiliary handle for use on a hand held implement as defined in claim 1 wherein the grip means comprises a substantially cylindrical grip attached to the third hinge means.

8. An auxiliary handle for use on a hand held implement as defined in claim 1 further comprising at least one bushing.

9. An auxiliary handle for use on a hand held implement as defined in claim 1 wherein the frame means is folded and the first hinge means and the second hinge means are located adjacently to each other.

10. An auxiliary handle for use on a hand held implement as defined in claim 1 wherein the frame means comprises a first arm and a second arm, the first and second arms being joined by the third hinge means.

11. An auxiliary handle to be attached to the original handle of a hand held implement, the auxiliary handle comprising:

a frame, the frame comprising a first arm and a second arm with both the first and second arms having distal ends, the frame being molded from a unitary first material;

a first hinge positioned at the distal end of the first arm, the first hinge being integrally molded as part of the first arm and comprised of the first material;

a second hinge positioned at the distal end of the second arm, the second hinge being integrally molded as part of the second arm and comprised of the first material;

a third hinge joining the first arm and the second arm and intermediately positioned between the distal ends of the first and second arms, the third hinge being integrally molded with the first and second arms and allowing the first arm and the second arm to be substantially folded against each other so that the first and second hinges are adjacent to each other and so that the first and second arms can be angularly oriented to each other;

a first clamp connected to the first hinge;

a second clamp connected to the second hinge; and a grip formed at substantially the position of the third hinge such that the first and second clamps can be attached to the original handle and a first distance between the grip and the original handle can be adjusted, an angular orientation of the grip in relation to the original handle can be adjusted, and a second distance between the first and second clamps can be adjusted thus providing an adjustable auxiliary handle for the user.

12. An auxiliary handle as defined in claim 11 wherein the first material comprises a polypropylene material and the first hinge, the second hinge, and the third hinge consists essentially of polypropylene.

13. An auxiliary handle as defined in claim 11 wherein the first and the second clamps both comprise a circular clamp comprising means for selectively tightening and loosening the circular clamp.

14. An auxiliary handle as defined in claim 11 further comprising a keeper positioned for receiving the end of the circular clamp.

15. An auxiliary handle as defined in claim 11 further comprising at least one bushing.

16. An auxiliary handle as defined in claim 11 wherein the frame is folded and the first hinge and the second hinge are located adjacently to each other.

17. An auxiliary handle to be attached to the original handle of a shovel, the auxiliary handle comprising:

a frame, the frame comprising a first arm and a second arm with both the first and second arms having distal ends, the frame being molded and consisting essentially of a polypropylene material;

a first hinge formed at the distal end of the first arm, the first hinge having an appendage extending therefrom and formed by narrowing the polypropylene material;

a second hinge formed at the distal end of the second arm, the second hinge having an appendage extending therefrom and formed by narrowing the polypropylene material;

a third hinge positioned as a joint connecting the first arm and the second arm, the third hinge formed by narrowing the polypropylene material, the third hinge allowing the first arm and the second arm to be substantially folded together and so that the first and second arms can be angularly oriented to each other in the range from about zero degrees to about 180 degrees;

a first circular clamp molded into the appendage connected to the second hinge, the first circular clamp having a circumference great enough to encircle at least a portion of the periphery of the original handle of the shovel;

a second circular clamp molded into the appendage connected to the second hinge, the second circular clamp having a circumference great enough to encircle at least a portion of the periphery of the original handle of the shovel;

at least one bushing having an outer circumference which is less than an inner circumference of either of the first or second circular clamps such that the bushing may be imposed between the inner circumference of the first clamp and the outer periphery of the original handle which is less than a predetermined value; and a grip formed at the position of the third hinge such that the first and second clamps can be attached to the original handle and (a) a first distance between the grip and the original handle can be adjusted, (b) an angular orientation of the grip in relation to the original handle can be adjusted, (c) a second distance between the first and second clamps can be adjusted, and (d) the locations where the first clamp and the second clamp clench the original handle of the shovel can be adjusted thus providing an adjustable auxiliary handle for the user of the shovel.

18. A method of forming an auxiliary handle for use on a hand held implement having a rigid original handle, the method comprising the steps of:

molding a frame means from a plastic material and providing a grip location thereon, the frame means having a first end and a second end, the frame means comprising a unitary piece of material free from any fasteners, the step of forming a frame means further comprising the steps of:

molding a first hinge at the first end of the frame means such that the first hinge is integral with the rest of the frame means;

molding a second hinge at the second end of the frame means such that the second hinge is integral with the rest of the frame means;

molding a third hinge in the frame at a position intermediate the position of the first hinge and the second hinge, the third hinge being integral with the rest of the frame means and allowing the frame means to fold;

attaching a first clamp to the first hinge, the first clamp configured for encircling and grasping the original handle of the implement such that the original handle of the implement is tightly held by the first clamp such that the original handle cannot substantially slide in relation thereto;

attaching a second clamp to the second hinge, the second clamp configured for encircling and grasping the original handle of the implement such that the original handle of the implement is tightly held by the second clamp such that the original handle cannot substantially slide in relation thereto; and forming a grip on the frame means for the user to grasp such that when the first and second clamps are attached to the original handle and a first distance between the grip and the original handle can be adjusted, an angular orientation of the grip in relation to the original handle can be adjusted, and a second distance between the first and second clamps can be adjusted thus providing an adjustable auxiliary handle for the user.

19. A method of forming an auxiliary handle for use on a hand held implement having an original handle as defined in claim 18:

wherein the step of molding a frame means from a plastic material comprises the step of molding a frame from a material comprising polypropylene;

wherein the steps of molding a first hinge and molding a second hinge each comprise the step of molding a hinge from a polypropylene material; and wherein the steps of attaching a first clamp to the first hinge and attaching a second clamp to the second hinge each comprise the step of molding a metallic clamp into each of the hinges.

* * * * *